US010288341B2

(12) United States Patent
Chae et al.

(10) Patent No.: US 10,288,341 B2
(45) Date of Patent: May 14, 2019

(54) REFRIGERATOR

(71) Applicant: LG ELECTRONICS INC., Seoul (KR)

(72) Inventors: Sunam Chae, Seoul (KR); Hojin Choi, Seoul (KR); Kangsoo Byun, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/313,889

(22) PCT Filed: Apr. 17, 2015

(86) PCT No.: PCT/KR2015/003898
§ 371 (c)(1),
(2) Date: Nov. 23, 2016

(87) PCT Pub. No.: WO2015/160227
PCT Pub. Date: Oct. 22, 2015

(65) Prior Publication Data

US 2018/0187947 A1 Jul. 5, 2018

(30) Foreign Application Priority Data

Apr. 18, 2014 (KR) ..... 10-2014-0046924

(51) Int. Cl.
*F25D 21/04* (2006.01)
*F25D 11/00* (2006.01)

(52) U.S. Cl.
CPC ..... *F25D 21/04* (2013.01); *F25B 2700/02* (2013.01); *F25D 11/00* (2013.01);
(Continued)

(58) Field of Classification Search
CPC ..... F25D 21/04; F25D 11/00; F25D 2600/04; F25D 2323/023; F25D 2400/02; F25B 2700/02
See application file for complete search history.

(56) References Cited

U.S. PATENT DOCUMENTS 3,052,100 A * 9/1962 Homkes ..... F25B 21/02 62/119
7,659,491 B2 * 2/2010 Yang ..... F25D 21/04 219/201

(Continued)

FOREIGN PATENT DOCUMENTS

CN 203704499 7/2014
EP 2083232 A2 7/2009

(Continued)

OTHER PUBLICATIONS

Extended European Search Report in European Application No. 15779719.2, dated Jan. 16, 2018, 8 pages.

(Continued)

*Primary Examiner* — Emmanuel Duke
(74) *Attorney, Agent, or Firm* — Fish & Richardson P.C.

(57) ABSTRACT

A refrigerator including a main body including a storage compartment defined therein, a cooling device for cooling the storage compartment, a door for opening and closing the storage compartment, a gasket disposed between the door and the main body to seal the storage compartment, and a heat source disposed around the door, wherein the heat source includes a plurality of heaters generating different quantities of heat.

20 Claims, 11 Drawing Sheets

(52) U.S. Cl.
CPC .... *F25D 2323/023* (2013.01); *F25D 2400/02* (2013.01); *F25D 2600/04* (2013.01)

(56) References Cited

U.S. PATENT DOCUMENTS

2010/0192608 A1* 8/2010 Lee ..... F25D 21/04 62/275
2012/0000899 A1* 1/2012 Eom ..... F25D 21/04 219/385
2012/0023986 A1* 2/2012 Chae ..... F25D 21/04 62/132
2012/0047919 A1* 3/2012 Besore ..... F25D 21/04 62/80
2012/0313497 A1* 12/2012 Jang ..... F25D 23/069 312/405
2013/0014533 A1* 1/2013 Choi ..... F25D 21/04 62/272
2013/0241385 A1* 9/2013 Lee ..... F25D 23/028 312/404

FOREIGN PATENT DOCUMENTS

EP 2085725 A2 8/2009
KR 10-2009-0092702 9/2009
KR 10-2010-0031337 3/2010
KR 10-2013-0113273 10/2013

OTHER PUBLICATIONS

International Search Report and Written Opinion in International Application No. PCT/KR2015/003898, dated Aug. 20, 2015, 9 pages.
Chinese Office Action in Chinese Application No. 201580032580.5, dated Jul. 4, 2018, 16 pages.

* cited by examiner

[Fig. 1]
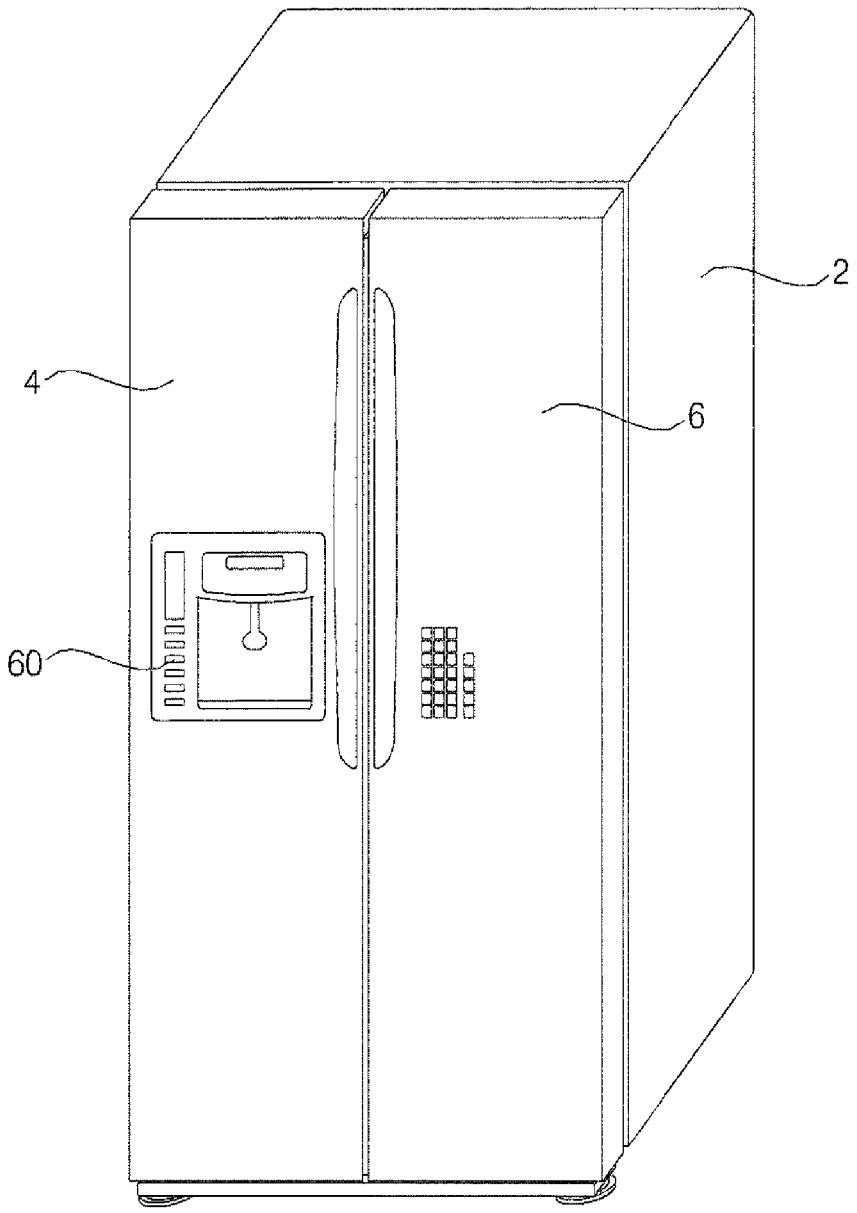

[Fig. 2]
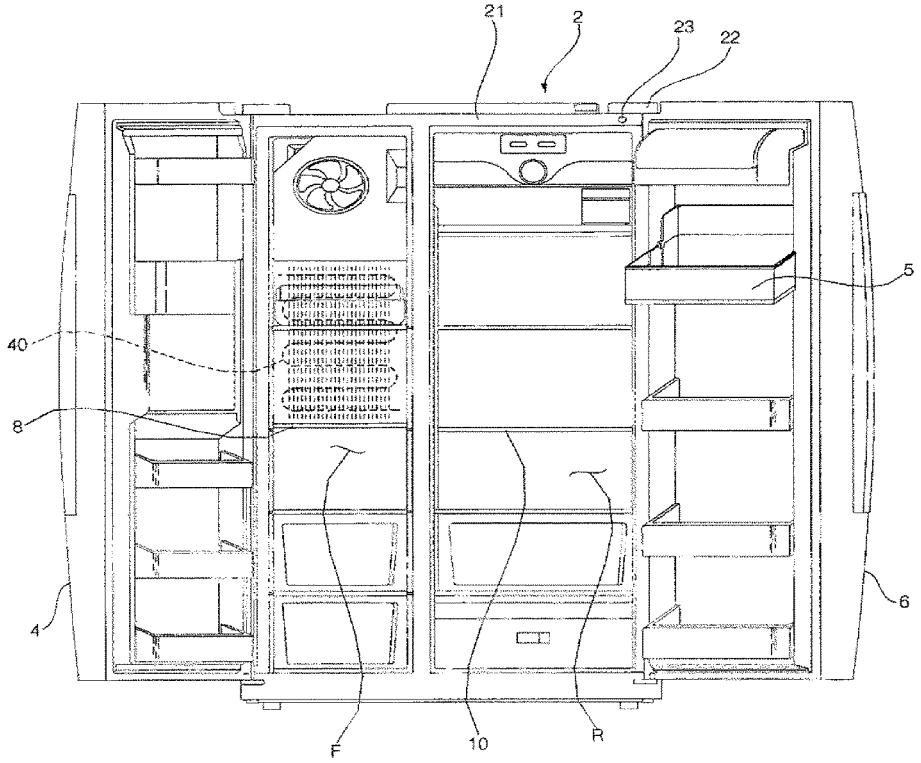

[Fig. 3]
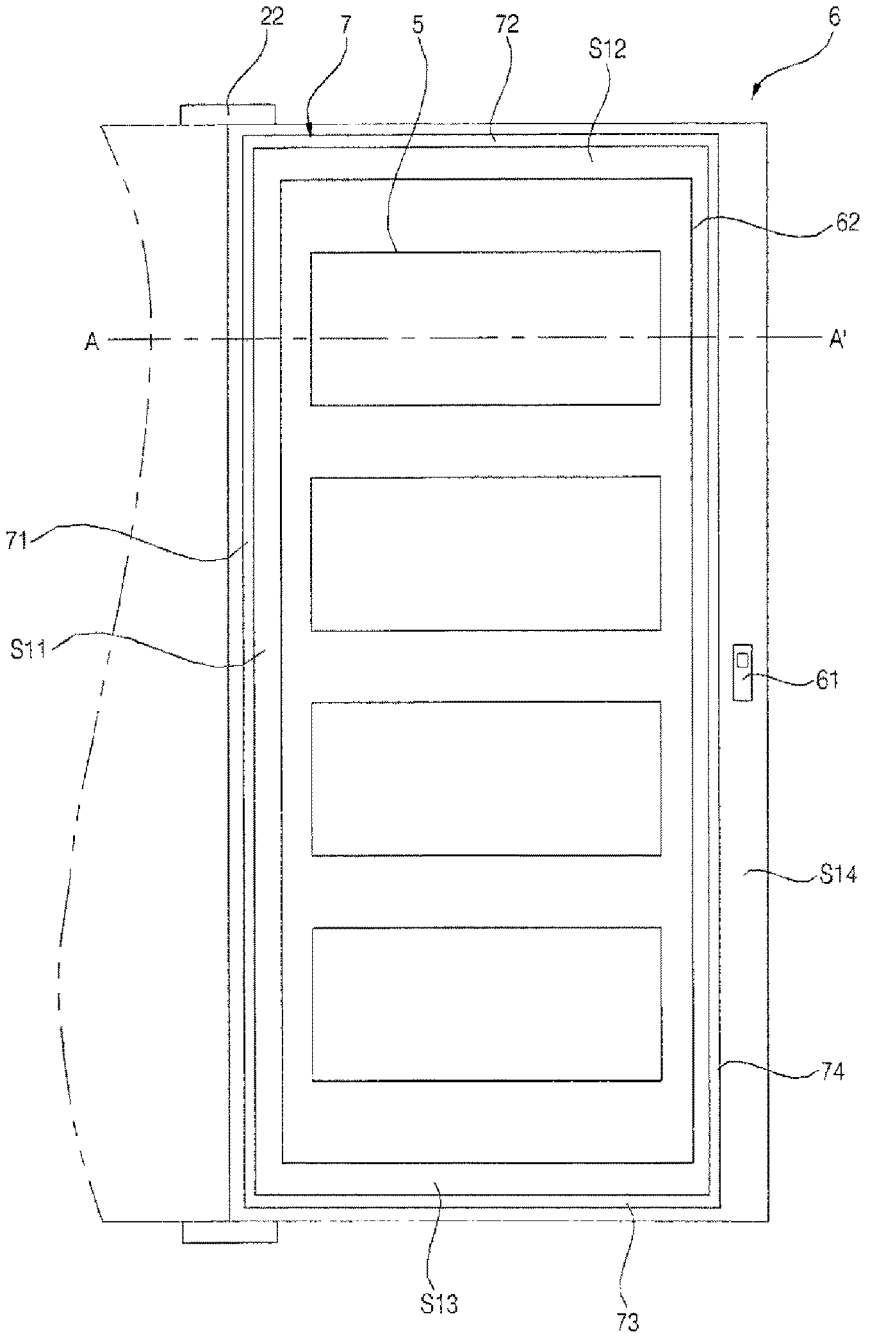

[Fig. 4]
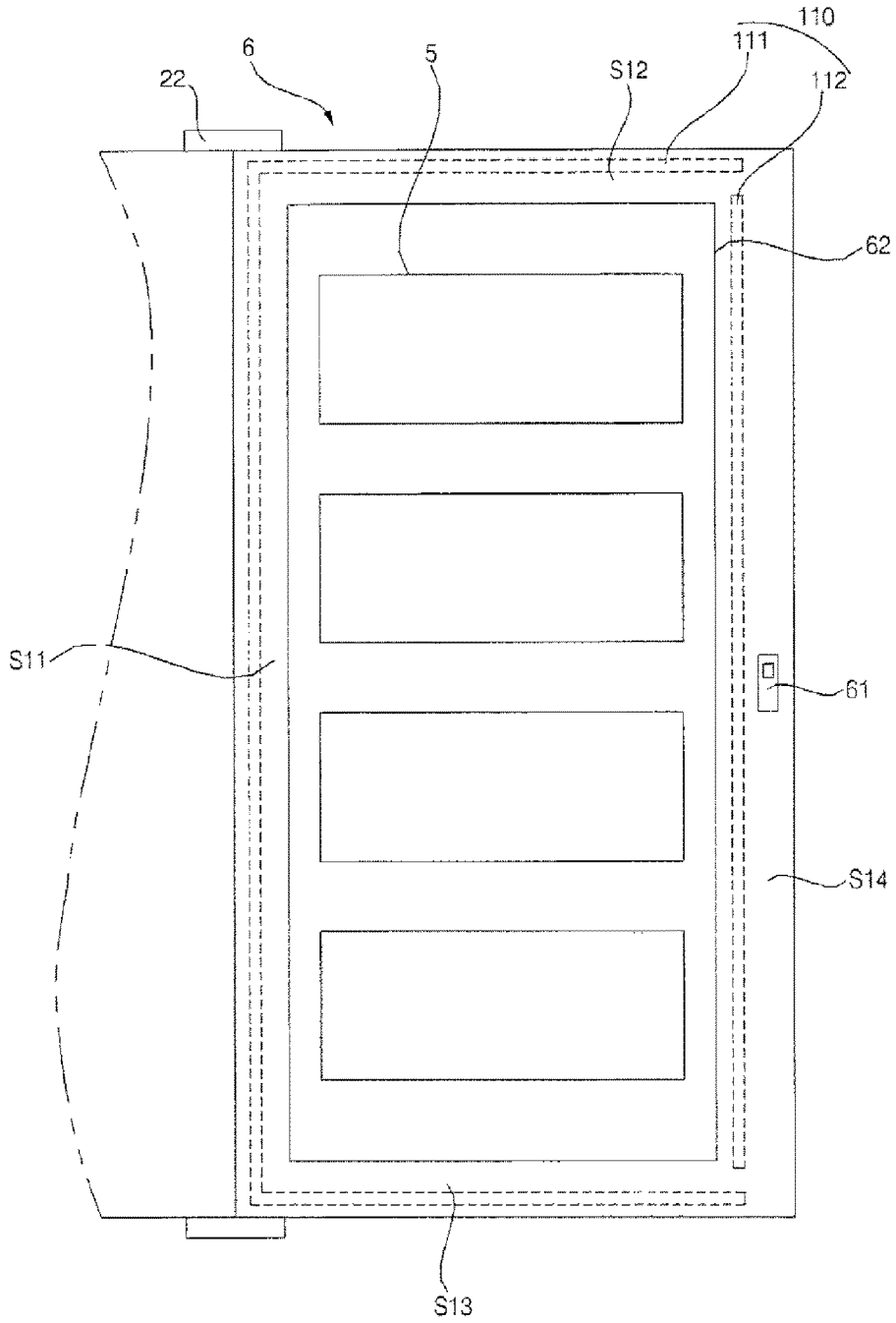

[Fig. 5]
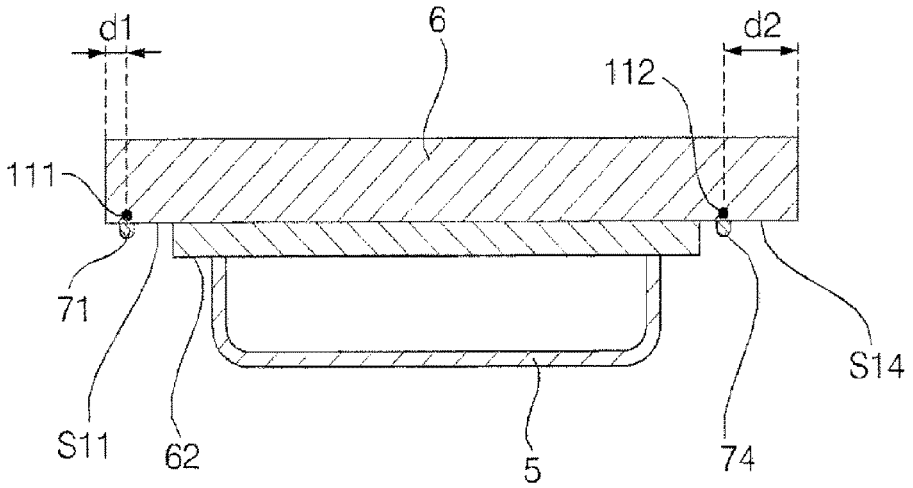

[Fig. 6]
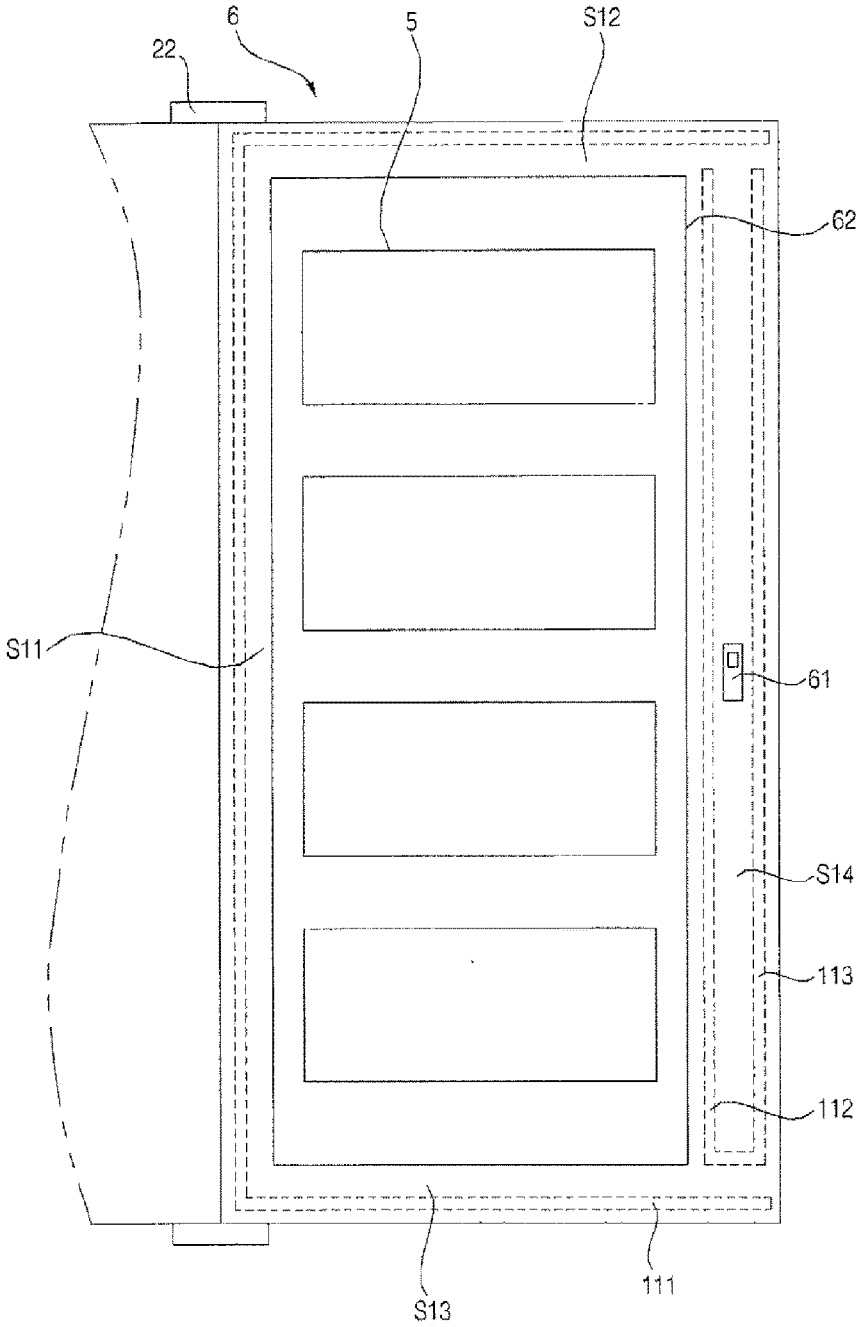

[Fig. 7]
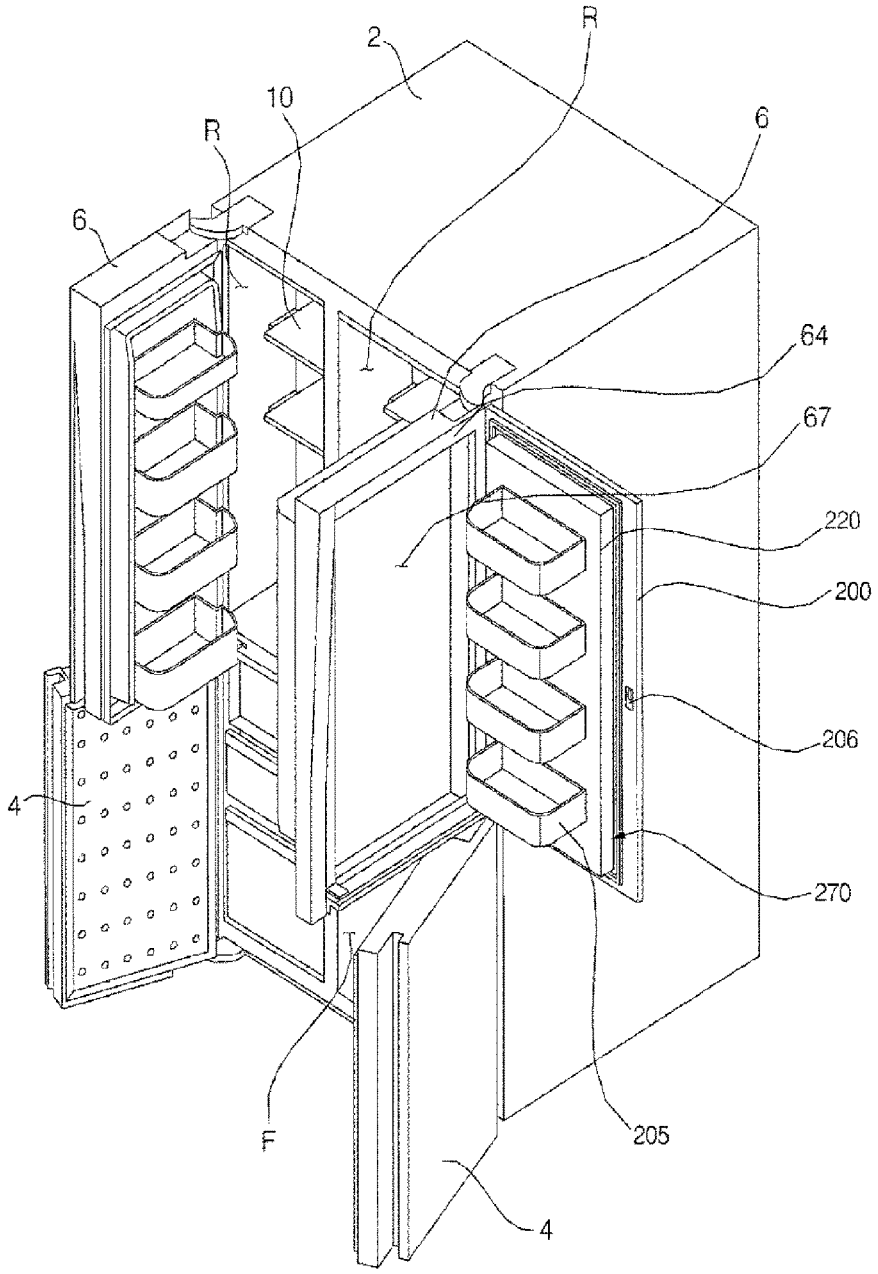

[Fig. 8]
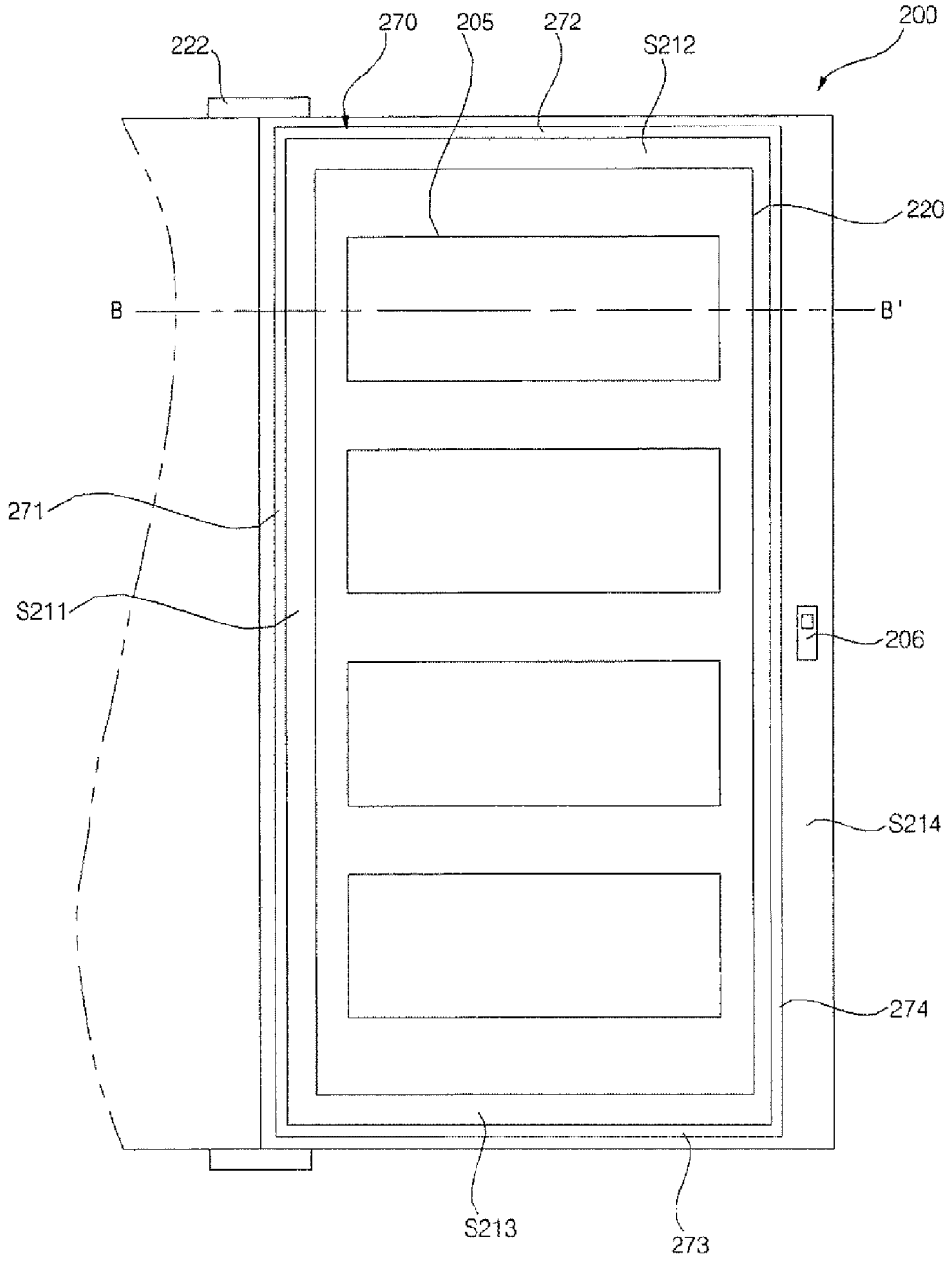

[Fig. 9]
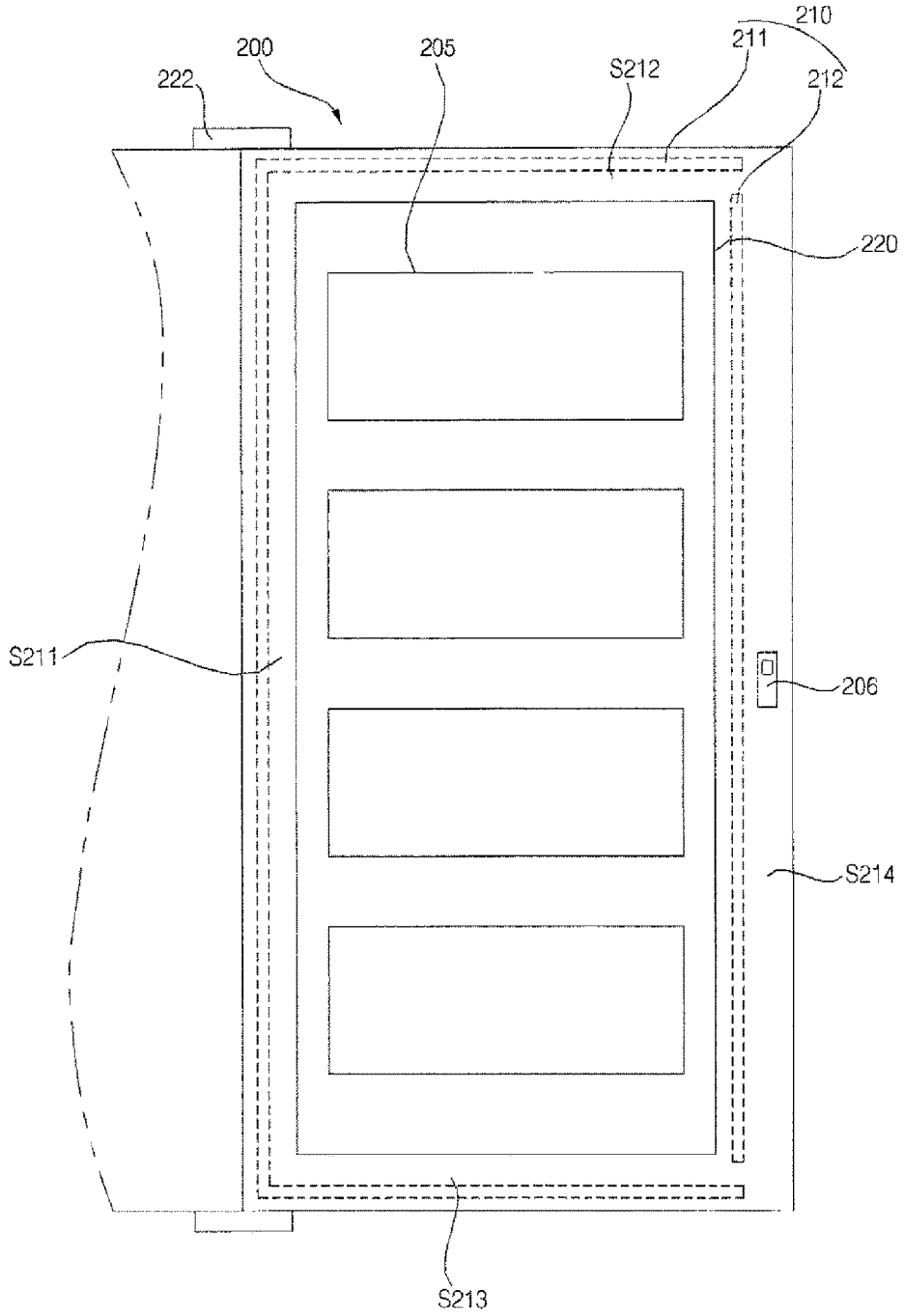

[Fig. 10]
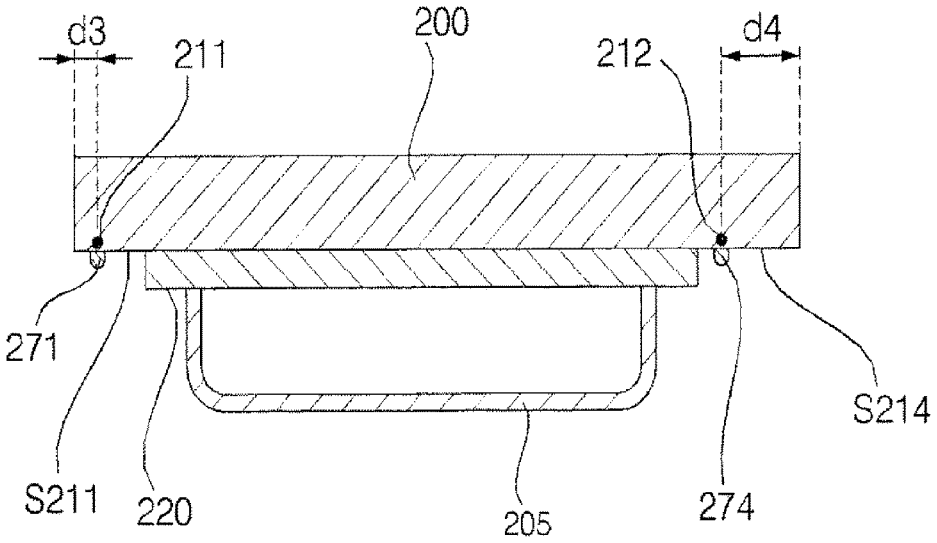

[Fig. 11]
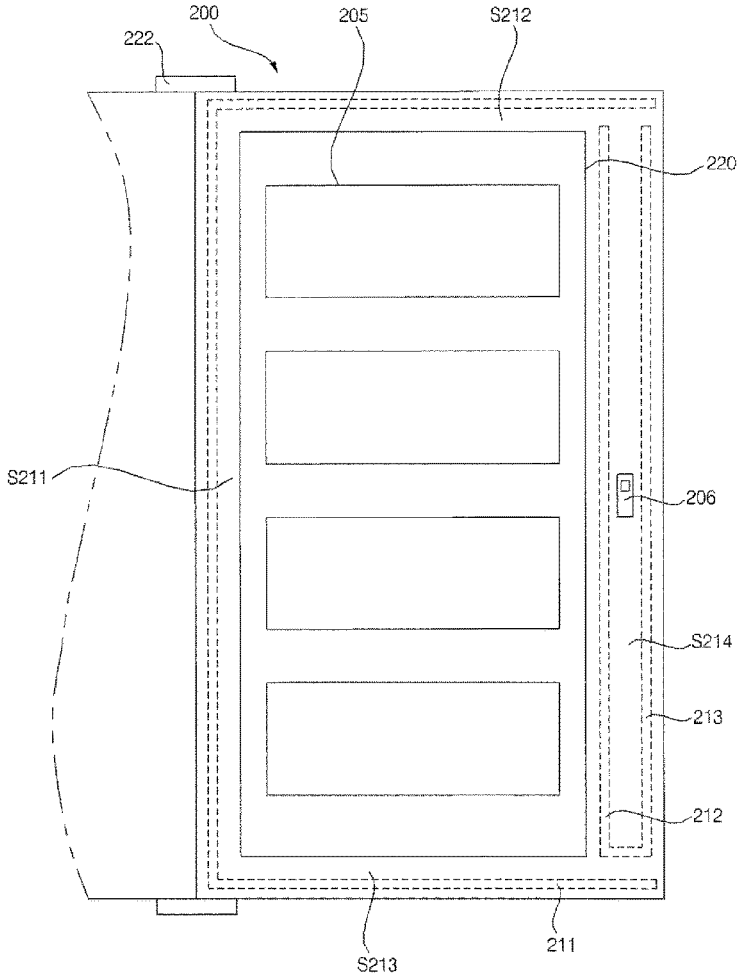
[Fig. 12]
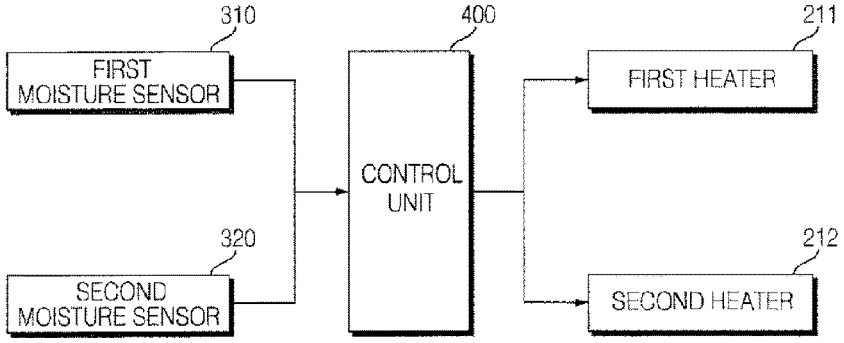

REFRIGERATOR

CROSS REFERENCE TO RELATED APPLICATIONS

This application is a U.S. National Phase Application under 35 U.S.C. § 371 of International Application No. PCT/KR2015/003898, filed on Apr. 17, 2015, which claims the benefit of Korean Application No. 10-2014-0046924, filed on Apr. 18, 2014, the entire contents of which are hereby incorporated by reference in their entireties.

TECHNICAL FIELD

The present invention relates to a refrigerator.

BACKGROUND

In general, a refrigerator is an apparatus that stores objects in a fresh state for a long period of time using cool air supplied into a storage compartment. The cool air supplied into the storage compartment is generated through heat exchange with a refrigerant. The cool air supplied into the storage compartment is uniformly distributed in the storage compartment by convection to store foods at desired temperature.

The storage compartment is defined in a main body forming the external appearance of the refrigerator. The storage compartment is open at the front thereof such that foods can be received through the opening. A door to open and close the storage compartment is mounted at the front of the storage compartment. The door is hinged to the main body to open and close the storage compartment.

Conventional refrigerators have a problem in that dew is formed at a home bar door due to temperature difference between a storage compartment of the refrigerator disposed inside the door and the outside of the refrigerator.

With change and improvement of dietary habits, such a refrigerator has gradually grown in size and becomes multifunctional. These days, many types of refrigerators having various structures designed for the user convenience are on the market. Recently, a refrigerator which is provided at a door with an additional home bar so as to allow foodstuffs such as beverages to be conveniently taken out of the refrigerator is gaining popularity.

The refrigerator including the home bar has a problem in that dew is formed at a home bar door due to temperature difference between a storage compartment of the refrigerator disposed inside the door and the outside of the refrigerator. In order to solve the problem, the home bar door is provided with a home bar heater.

However, when a gasket for shielding the inside of the home bar from the outside is disposed excessively close to a peripheral edge of a sealing component, the gasket is cooled due to cool air leaking through a space between the sealing component and the inside of the home bar door, thus causing formation of dew at the gasket.

In a case of a heater having the same quantity of heat (per unit time) throughout the length, when temperature difference is generated between peripheral regions of home bar door, a heat source is activated depending on the lowest temperature among those of the regions, thus causing energy waste.

Technical Problem

It is an object of the present invention to provide a refrigerator designed to efficiently prevent formation of dew at a door and a home bar door thereof.

Technical Solution

In accordance with an aspect of the present invention, the above and other objects can be accomplished by the provision of a refrigerator including a main body including a storage compartment defined therein, a cooling device for cooling the storage compartment, a door for opening and closing the storage compartment, a gasket disposed between the door and the main body to seal the storage compartment, and a heat source disposed around the door, wherein the heat source includes a plurality of heaters generating different quantities of heat.

BRIEF DESCRIPTION OF DRAWINGS

The above and other objects, features and other advantages of the present invention will be more clearly understood from the following detailed description taken in conjunction with the accompanying drawings, in which:

FIG. 1 is a perspective view showing a refrigerator according to a first embodiment of the present invention;

FIG. 2 is a front view showing the refrigerator shown in FIG. 1 in which doors of the refrigerator are opened;

FIG. 3 is a rear view showing a rear surface of the door shown in FIG. 1;

FIG. 4 is a rear view showing the rear surface of the door shown in FIG. 3 from which the gasket is removed;

FIG. 5 is a cross-sectional view taken along line A-A' of FIG. 3;

FIG. 6 is a rear view showing another example of the heat source according to the present invention;

FIG. 7 is a perspective view showing a refrigerator according to a second embodiment of the present invention;

FIG. 8 is a rear view showing a rear surface of a home bar shown in FIG. 7;

FIG. 9 is a rear view showing the rear surface of the home bar shown in FIG. 8 from which a gasket is removed;

FIG. 10 is a cross-sectional view taken along line B-B' of FIG. 8;

FIG. 11 is a rear view showing another example of the heat source according to the present invention; and FIG. 12 is a control block diagram of the refrigerator according to the second embodiment of the present invention.

DETAILED DESCRIPTION

Advantages and features of the present invention and a method of achieving the same will be more clearly understood from embodiments described below with reference to the accompanying drawings. However, the present invention is not limited to the following embodiments and may be implemented in various different forms. The embodiments are provided merely for complete disclosure of the present invention and to fully provide a person having ordinary skill in the art to which the present invention pertains with the category of the invention. The invention is defined only by the scope of the claims. Wherever possible, the same reference numbers will be used throughout the specification to refer to the same or like elements.

Unless otherwise defined, all terms (including technical and scientific terms) used in this specification have the same meaning as commonly understood by a person having ordinary skill in the art to which the present invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each element is exaggerated, omitted, or schematically illustrated for convenience of description and clarity. In addition, the size or area of each element does not entirely reflect the actual size thereof.

In addition, angles or directions used to describe the structures of embodiments of the present invention are based on those shown in the drawings. Unless there is, in this specification, no definition of a reference point to describe angular positional relations in the structures of embodiments of the present invention, the associated drawings may be referred to.

Hereinafter, refrigerators according to embodiments of the present invention will be described with reference to the accompanying drawings.

FIG. 1 is a perspective view showing a refrigerator according to an embodiment of the present invention, and FIG. 2 is a front view showing the refrigerator shown in FIG. 1 in which doors of the refrigerator are opened.

As shown in FIGS. 1 and 2, the refrigerator according to the embodiment of the present invention includes a main body 2 having storage compartments F and R defined therein, a cooling device 40 for cooling the storage compartments F and R, and doors 4 and 6 for opening and closing the storage compartments F and R, respectively.

The refrigerator according to the embodiment may further include a gasket, and a heat source 110 disposed at a periphery of the doors 4 and 6.

The cooling device 40 exchange heat with the outside to cool the storage compartments F and R. The cooling device 40 may be constituted by a refrigeration cycle device including a compressor, a condenser, an expansion unit, and an evaporator. Alternatively, the cooling device 40 may be constituted by a thermoelectric element that includes first and second different metals spaced apart from each other such that one of the first and second metals absorbs heat and the other of the first and second metals radiates heat by applying current to the first and second metals. Hereinafter, the cooling device 40 will be described as being constituted by the refrigeration cycle device.

The cooling device 40 circulates a refrigerant in order of the compressor-> the condenser-> the expansion device-> the evaporator-> the compressor to cool the storage compartments F and R.

The evaporator of the cooling device 40 may be disposed in contact with the outer walls of the storage compartments F and R to directly cool the storage compartments F and R. Alternatively, the cooling device 40 may further include a cool air circulation fan 50 to circulate air in the storage compartments F and R through the evaporator and the storage compartments F and R such that the air in the storage compartments F and R can cool the storage compartments F and R while circulating through the storage compartments F and R and the evaporator.

The storage compartments F and R of the main body 2 may be provided therein with shelves 8 and 10, on which objects, such as foodstuffs and side dishes, to be stored are placed.

In addition, the storage compartments F and R of the main body 2 may be provided therein with a vegetable container for storing vegetables and fruits.

The storage compartments F and R may be defined in the main body 2 by storage compartment frames 21. The storage compartment frames 21 provide areas with which the doors 4 and 6 come into contact, and define walls of the storage compartments F and R.

The storage compartment frames 21 are formed to correspond to the peripheries of rear surfaces of the doors 4 and 6 so as to closely contact the rear surfaces.

Specifically, the storage compartment frames 21 have respective inner surfaces that are inwardly stepped and come into close contact with the doors 4 and 6.

The doors 4 and 6 are installed at the main body 2 so as to be swung in the left and right direction or in the upward and downward direction. A door basket 5 to store drinks such as spring water, milk, juice, and alcoholic beverages or ices such as ice cream is disposed at the side (i.e. the rear) of the doors 4 and 6 which faces the storage compartments F and R when the doors 4 and 6 are closed.

The door basket 5 is preferably composed of a plurality of door baskets 5 which are mounted at the doors 4 and 6 so as to be vertically spaced apart from each other.

The storage compartments F and R may include a freezing compartment F and a refrigerating compartment R. The doors 4 and 6 may include a freezing compartment door 4 for opening and closing the freezing compartment F and a refrigerating compartment door 6 for opening and closing the refrigerating compartment R. The shelves 8 and 10 may include a freezing compailinent shelf 8 disposed in the freezing compartment F and a refrigerating compartment shelf 10 disposed in the refrigerating compartment R. The door basket 5 may be mounted in the freezing compartment F to store objects, such as ice cream, to be frozen or in the refrigerating compartment R to store objects, such as milk, juice, and alcoholic beverages, to be refrigerated.

Each of the doors 4 and 6 may further include a home bar door 200 which will be described later.

FIG. 3 is a rear view showing a rear surface of the door shown in FIG. 1. FIG. 4 is a rear view showing the rear surface of the door shown in FIG. 3 from which the gasket is removed. FIG. 5 is a cross-sectional view taken along line A-A' of FIG. 3.

Although FIGS. 3 to 5 illustrate the refrigerating compartment door 6, the freezing compartment door 4 may also be constructed in the same manner.

Referring to FIG. 3, the doors 4 and 6 are hinged to the main body 2 by means of hinges 22 to open and close the storage compartments F and R, respectively.

The doors 4 and 6 may have any size and shape so long as they shield the storage compartments F and R. By way of example, the storage compartment frames 21 constituting the walls of the storage compar tnients F and R may be configured to have a rectangular shape such that the storage compartment frames 21 closely contact peripheries of the doors 4 and 6.

The door basket 5 for supporting storage objects may be disposed at the center of the rear surface of each of the doors 4 and 6. A locking unit may be further provided to couple each of the doors 4 and 6 to the main body 2.

The locking unit may include a latch 61 formed at the rear surface of each of the doors 4 and 6, and a latch hole (not shown) formed at the main body 2 to engage with the latch 61.

Each of the doors 4 and 6 may be further provided at the rear surface thereof with a sealing member 62. The sealing member 62 is shaped to protrude rearward from the rear surface of each of the doors 4 and 6. The sealing member 62 is shaped to correspond to the periphery of the storage compartment frame 21 when each of the doors 4 and 6 is closed. Specifically, the sealing member 62 may protrude from the rear surface of each of the doors 4 and 6 to have a stepped shape.

There is a problem that dew is formed at the doors 4 and 6 due to temperature difference between the storage compartments positioned inside the doors 4 and 6 and the outside. Outward leaking of cool air in the storage compartments is primarily prevented by the sealing member 62. Since the sealing member 62 is inserted into the storage compartment frame 21 by swinging of the doors 4 and 6, a certain tolerance is present between the sealing member 62 and the storage compartment frame 21. Owing to the tolerance, some of the cool air may leak to the outside.

If it is possible to seal the inside and the outside of the refrigerator only by means of the gasket 7 which will be described later, the sealing member 62 may be omitted.

The gasket 7 is positioned between the doors 4 and 6 and the main body 2 to seal the storage compartments F and R.

In order to prevent outside air from infiltrating the storage compartments F and R, the gasket 7 may constitute a closed loop surrounding at least the storage compartments F and R.

Specifically, the gasket 7 may be disposed between the storage compartment frames 21 constituting the walls of the storage compartments F and R and the rear surfaces of the doors 4 and 6 contacting the storage compartment frames 21. Furthermore, the gasket 7 may be attached to the storage compartment frames 21 or the rear surfaces of the doors 4 and 6.

More specifically, the gasket 7 may be attached to peripheries of the doors 4 and 6. Accordingly, the gasket 7 may closely contact the rear surfaces of the doors 4 and 6 when the doors 4 and 6 are closed, and thus the storage compartments may be maintained in the sealed state by means of the gasket 7.

Alternatively, the gasket 7 may be disposed to surround the sealing member 62 in the state of being outwardly spaced apart from the sealing member 62.

Since the gasket 7 is positioned around the doors 4 and 6, there is a problem that dew is formed at a region of the gasket 7 that contacts cool air in the storage compartments F and R.

In one embodiment, in order to solve the problem, a periphery of each of the doors 4 and 6 is divided into a plurality of peripheral sections and the gasket 7 is differently positioned at the plurality of peripheral sections.

Specifically, when the locking unit (for example, the latch 61) is positioned inside the closed loop of the gasket 7, the locking unit decreases in temperature. Hence, when the doors 4 and 6 are opened, dew formed at the locking unit is recognized by a user. Furthermore, when the gasket 7 is positioned excessively close to peripheral edges of the sealing member 62, the gasket 7 is cooled by cool air leaking through clearance between the sealing member 62 and the storage frame 21, thus disadvantageously causing formation of dew at the gasket 7.

Referring to FIG. 3, in this embodiment, the locking unit is positioned outside the closed loop of the gasket 7 and is positioned close to the peripheral edge of the rear surface of each of the doors 4 and 6.

The peripheral region of the rear surface of each of the doors 4 and 6 may be divided into an upper peripheral section S12, a lower peripheral section S13, a left peripheral section S1 close to the hinge 22, and a right peripheral section S14 close to the locking unit (latch). Here, the upper peripheral section S12, the lower peripheral section S13 and the left peripheral section Sll may be defined as a first peripheral section S11, S12 and S13, and the right peripheral section S14 may be defined as a second peripheral section S14.

Correspondingly, the gasket 7 may include a first gasket section 71, 72 and 73 disposed at the first peripheral section S11, S12 and S13, and a second gasket section 74 disposed at the second peripheral section S14. The first gasket section 71, 72 and 73 may be positioned closer to the peripheral edge of each of the doors 4 and 6 than the second gasket section 74.

The first gasket section 71, 72 and 73 and the second gasket section 74 are connected to each other to form a closed loop. Here, the peripheral edge of each of the doors 4 and 6 means a border line at which the rear surface of each of the doors 4 and 6 is connected to a lateral surface of each of the doors 4 and 6.

As shown in FIG. 5, a spacing distance dl between the first gasket section 71, 72 and 73 and the peripheral edge of each of the doors 4 and 6 may be smaller than a spacing distance d2 between the second gasket section 74 and the peripheral edge of each of the doors 4 and 6. Furthermore, a spacing distance between the first gasket section 71, 72 and 73 and the peripheral edge of the sealing member 62 may be larger than a spacing distance between the second gasket section 74 and the peripheral edge of the sealing member 62.

Consequently, formation of dew at the locking unit may be prevented. In addition, since the gasket 7 is disposed in the space between the sealing member 62 and the storage compartment frame 21 so as to be spaced from the sealing member 62 as much as possible, temperature of the gasket 7 does not decrease below the saturation temperature of dew, thus preventing formation of dew at the gasket 7.

The locking unit is positioned outside the closed loop constituted by the gasket 7. In other words, the locking unit is positioned between the second gasket section 74 and the peripheral edge of each of the doors 4 and 6.

Referring to FIGS. 4 and 5, the heat source 110 functions to heat the peripheral region of each of the doors 4 and 6 to prevent formation of dew at the gasket 7 and the peripheral region of the door.

The heat source 110 is positioned along the peripheral region of each of the doors 4 and 6. Specifically, the heat source 110 may be disposed at a position corresponding to the gasket 7. In other words, the heat source 110 may be positioned to overlap the gasket 7.

The heat source 110 may be embedded in the storage compartment frame 21 constituting the wall of each of the storage compartments F and R or in the rear surface of each of the doors 4 and 6 contacting the storage compartment frame 21.

In the case of a heat source 110 having the same quantity of heat (per unit time) throughout the length thereof, when temperature difference is generated between peripheral regions of each of the doors 4 and 6, the heat source 110 is activated depending on the lowest temperature among temperatures of the peripheral regions, thus causing energy waste.

In order to solve the problem, in this embodiment, periphery of each of the doors 4 and 6 is divided into a plurality of regions, and heaters generating different quantities of heat (per unit time) are provided at the plurality of regions, respectively.

Specifically, the heat source 110 may include a plurality of heaters generating different quantities of heat or different quantities of heat per unit time. Accordingly, it is possible to supply different quantities of heat in accordance with temperatures of the peripheral regions of each of the doors 4 and 6, thus conserving energy.

By way of example, the heat source 110 may include a first heater 111 provided at the first peripheral section S11, S12 and S13 of each of the doors 4 and 6, and a second heater 112 provided at the second peripheral section S14 of each of the doors 4 and 6. The first heater 111 is positioned closer to the peripheral edge of each of the doors 4 and 6 than the second heater 112, and the locking unit may be disposed between the second heater 112 and the peripheral edge of each of the doors 4 and 6. In other words, the first heater 111 may be positioned to correspond to the first gasket section 71, 72 and 73, and the second heater 112 may be positioned to correspond to the second gasket section 74.

As shown in FIG. 5, a spacing distance between the first heater 111 and the peripheral edge of each of the doors 4 and 6 may be smaller than a spacing distance between the second heater 112 and the peripheral edge of each of the doors 4 and 6.

The heat source 110 may be disposed to surround the sealing member 62 in the state of being outwardly spaced apart from the sealing member 62. A spacing distance between the first heater 111 and the edge of the sealing member 62 may be larger than that between the second heater 112 and the edge of the sealing member 62.

The first heater 111 may have a quantity of heat per unit time smaller than that of the second heater 112. Accordingly, the second heater 112, which is positioned close to a space defined between the sealing member 62 and the storage compartment frame 21, supplies a larger quantity of heat per unit time whereas the first heater 111, which is positioned far from the space defined between the sealing member 62 and the storage compartment frame 21, supplies a smaller quantity of heat per unit time than the second heater 112. Consequently, the second gasket section 74, which is positioned close to the space defined between the sealing member 62 and the storage compartment frame 21 and thus easily decreases to the saturation temperature, is supplied a larger quantity of heat, and the first gasket section 71, 72 and 73, which is positioned far from the space defined between the sealing member 62 and the storage compartment frame 21, is supplied a smaller quantity of heat.

Accordingly, the embodiment uses a plurality of heaters generating different quantities of heat per unit time so as to supply a larger quantity of heat to a gasket section that easily decreases in temperature and to supply a smaller quantity of heat to a gasket section that does not easily decrease in temperature. As a result, energy is conserved, and formation of dew at the gasket 7 is quickly prevented.

The first heater 111 and the second heater 112 may create heat in various ways. For example, the first heater 111 and the second heater 112 may be embodied as an electric heater that is activated by electric energy. The embodiment of the first heater 111 and the second heater 112 by the electric heater provides an advantage of facilitated temperature control.

The first heater 111 and the second heater 112 may be configured to generate different quantities of heat per unit time.

In an example, the first heater 111 and the second heater 112 may have different electric powers (W). Specifically, electric power of the second heater 112 may be higher than that of first heater 111.

In another example, the first heater 111 and the second heater 112 may have different resistances. Specifically, the second heater 112 may have a higher resistance than that of the first heater 111.

In a further example, although the first heater 111 and the second heater 112 have the same resistance, there may be difference between rates of an ON time with respect to a unit time of the first heater 111 and the second heater 112. Specifically, the second heater 112 may have a higher rate of an ON time with respect to a unit time than that of the first heater 111.

FIG. 6 is a rear view showing another example of the heat source according to the present invention.

Referring to FIG. 6, the heat source 110 may further include a third heater 113 positioned between the locking unit and a peripheral edge of each of the doors 4 and 6.

Specifically, the third heater 113 may be positioned closer to the peripheral edge of each of the doors 4 and 6 than the locking unit. Consequently, formation of dew at the locking unit may be prevented.

By way of example, the third heater 113 may be connected to the second heater 112, and the third heater 113 and the second heater 112 may be embodied as heaters generating the same quantity of heat per unit time.

FIG. 7 is a perspective view showing a refrigerator according to a second embodiment of the present invention. FIG. 8 is a rear view showing a rear surface of a home bar shown in FIG. 7. FIG. 9 is a rear view showing the rear surface of the home bar shown in FIG. 8 from which a gasket is removed. FIG. 10 is a cross-sectional view taken along line B-B' of FIG. 8.

The refrigerator according to the second embodiment of the present invention includes a main body 2 having storage compartments F and R defined therein, a cooling device 40 for cooling the storage compartments F and R, doors 4 and 6 for opening and closing the storage compartments F and R, respectively, a home bar frame 64 defining a recess 67 in the door 6, a home bar door 200 hinged to the home bar frame 64 to open and close the recess 67, a gasket 270 for sealing the recess 67, and a heat source 210.

The main body 2, the cooling device 40, and the doors 4 and 6 according to the second embodiment are the same as described in the first embodiment.

The home bar frame 64 is mounted on the door 6, and is constructed to have a rectangular frame including the recess 67 defined therein.

The home bar frame 64 provides a region which contacts the home bar door 200, and serves as a frame defining the recess 67.

The home bar frame 64 is configured to correspond to a peripheral region of a rear surface of the home bar door 200 and thus to closely contact the rear surface.

In other words, the home bar frame 64 has a stepped inside surface so as to closely contact the home bar door 200.

The home bar door 200 is hinged by means of a hinge 222 so as to open and close the recess 67.

The home bar door 200 may have a size and a shape sufficient to shield at least the recess 67. By way of example, the home bar frame 64 serving as a frame defining the recess 67 is configured to have a rectangular shape such that the home bar frame 64 contacts the peripheral region of the home bar door 200.

The home bar door 200 may be positioned in front of the door 6. The home bar door 200 may be provided at the rear surface thereof with a home bar door basket 205 and a locking unit for coupling the home bar door 200 to the door 6.

The locking unit may include a latch 206 provided at the rear surface of the home bar door 200, and a latch hole (not shown) formed at the home bar frame 64 and engaging with the latch 206.

The home bar door 200 may further be provided at the rear surface thereof with a sealing member 220. The sealing member 220 protrudes from the rear surface of the home bar door 200. The sealing member 220 is shaped such that it corresponds to a peripheral region of the home bar frame 64 when the home bar door 200 is closed. In other words, the sealing member 220 may protrude from the rear surface of the home bar door 200 to form a stepped structure.

There is a problem that dew is formed at the home bar door 200 due to temperature difference between the recess 67 defined in the home bar door 200 and the outside.

Outward leaking of cool air in the recess 67 is primarily prevented by the sealing member 220. Since the sealing member 220 is inserted into the home bar frame 64 by swinging of the home bar door 200, a certain tolerance is present between the sealing member 220 and the home bar frame 64. Owing to the tolerance, some of the cool air leaks to the outside.

If it is possible to seal the inside and the outside of the refrigerator only by means of the gasket 270 which will be described later, the sealing member 220 may be omitted.

The gasket 270 is positioned between the home bar door 200 and the home bar frame 64 to seal the recess 67.

In order to prevent outside air from infiltrating the recess 67, the gasket 270 may constitute a closed loop surrounding at least the recess 67.

Specifically, the gasket 270 may be disposed between the home bar frame 27 constituting the wall of the recess 67 and the rear surfaces of the home bar door 200 contacting the home bar frame 64. Furthetmore, the gasket 270 may be attached to the home bar frame 64 or the rear surface of the home bar door 200.

More specifically, the gasket 270 may be attached to the periphery of the home bar door 200. Accordingly, the gasket 270 may closely contact the rear surfaces of the home bar door 200 when the home bar door 200 is closed, and thus the recess 67 may be maintained in the sealed condition by means of the gasket 270.

Alternatively, the gasket 270 may be disposed to surround the sealing member 220 in the state of being outwardly spaced apart from the sealing member 220.

Since the gasket 270 is positioned around the home bar door 200, there is a problem that dew is fottned at a region of the gasket 270 which contacts cool air in the recess 67.

In one embodiment, in order to solve the problem, a periphery of the home bar door 200 is divided into a plurality of peripheral sections and the gasket 270 is differently positioned at the plurality of peripheral sections.

Specifically, when the locking unit (for example, the latch 206) is positioned inside the closed loop of the gasket 270, the locking unit decreases in temperature. Hence, when the home bar door 200 is opened, dew formed at the locking unit is recognized by a user. Furthermore, when the gasket 270 is positioned excessively close to a peripheral edge of the sealing member 220, the gasket 270 is cooled by cool air leaking through clearance between the sealing member 220 and the home bar frame 64, thus disadvantageously causing formation of dew at the gasket 270.

Referring to FIG. 8, in this embodiment, the locking unit is positioned outside the closed loop of the gasket 270 and is positioned close to the peripheral edge of the rear surface of the home bar door 200.

The peripheral region of the rear surface of the home bar door 200 may be divided into an upper peripheral section S212, a lower peripheral section S213, a left peripheral section S211 close to the hinge 222, and a right peripheral section S214 close to the locking unit (latch 206). Here, the upper peripheral section S212, the lower peripheral section S213 and the left peripheral section S211 may be defined as a first peripheral section S211, S212 and S213, and the right peripheral section S214 may be defined as a second peripheral section S214.

Correspondingly, the gasket 270 may include a first gasket section 271, 272 and 273 disposed at the first peripheral section S211, S212 and S213, and a second gasket section 274 disposed at the second peripheral section S214. The first gasket section 271, 272 and 273 may be positioned closer to the peripheral edge of the home bar door 200 than the second gasket section 274. The first gasket section 271, 272 and 273 and the second gasket section 274 are connected to each other to form a closed loop. Here, the peripheral edge of the home bar door 200 means a border line at which the rear surface of the home bar door 200 is connected to a lateral surface of the home bar door 200.

As shown in FIG. 10, a spacing distance d3 between the first gasket section 271, 272 and 273 and the peripheral edge of the home bar door 200 may be smaller than a spacing distance d4 between the second gasket section 274 and the peripheral edge of the home bar door 200. Furthermore, a spacing distance between the first gasket section 271, 272 and 273 and the peripheral edge of the sealing member 220 may be larger than a spacing distance between the second gasket section 274 and the peripheral edge of the sealing member 220.

Consequently, formation of dew at the locking unit may be prevented. In addition, since the gasket 270 is disposed in the space between the sealing member 220 and the home bar frame 64 so as to be spaced from the sealing member 220 as much as possible, temperature of the gasket 270 does not decrease below the saturation temperature of dew, thus preventing formation of dew at the gasket 270.

The locking unit is positioned outside the closed loop constituted by the gasket 270. In other words, the locking unit is positioned between the second gasket section 274 and the peripheral edge of the home bar door 200.

Referring to FIGS. 9 and 10, the heat source 210 functions to heat the peripheral region of the home bar door 200 to prevent foimation of dew at the gasket 270 and the peripheral region of the home bar door 200.

The heat source 210 is positioned along the peripheral region of the home bar door 200. Specifically, the heat source 210 may be disposed at a position corresponding to the gasket 270. In other words, the heat source 210 may be positioned to overlap the gasket 270.

The heat source 210 may be embedded in the home bar frame 64 constituting the wall of the recess 67 or in the rear surface of the home bar door 200 contacting the home bar frame 64.

In the case of a heat source 210 generating the same quantity of heat (per unit time) throughout the length thereof, when temperature difference is generated between peripheral regions of the home bar door 200, the heat source 210 is activated depending on the lowest temperature among those of the sections, thus causing energy waste.

In order to solve the problem, in this embodiment, periphery of the home bar door 200 is divided into a plurality of regions, and heaters generating different quantities of heat (per unit time) are provided at the plurality of regions.

Specifically, the heat source 210 may include a plurality of heaters generating different quantities of heat or different quantities of heat per unit time. Accordingly, it is possible to supply different quantities of heat in accordance with temperatures of the peripheral regions of the home bar door 200, thus conserving energy.

By way of example, the heat source 210 may include a first heater 211 provided at the first peripheral section S211, S212 and S213 of the home bar door 200, and a second heater 212 provided at the second peripheral section S214 of the home bar door 200. The first heater 211 is positioned closer to the peripheral edge of the home bar door 200 than the second heater 212, and the locking unit may be disposed between the second heater 212 and the peripheral edge of the home bar door 200. In other words, the first heater 211 may be positioned to correspond to the first gasket section 271, 272 and 273, and the second heater 212 may be positioned to correspond to the second gasket section 274.

More specifically, a spacing distance between the first heater 211 and the peripheral edge of the home bar door 200 may be smaller than a spacing distance between the second heater 212 and the peripheral edge of the home bar door 200. Furthermore, a spacing distance between the first heater 211 and the edge of the sealing member 220 may be larger than that between the second heater 212 and the edge of the sealing member 220.

The first heater 211 may generate a quantity of heat per unit time smaller than that of the second heater 212. Accordingly, the second heater 212, which is positioned close to a space defined between the sealing member 220 and the home bar frame 64, supplies a larger quantity of heat per unit time whereas the first heater 211, which is positioned far from the space defined between the sealing member 220 and the home bar frame 64, supplies a smaller quantity of heat per unit time than the second heater 212. Consequently, the second gasket section 274, which is positioned close to the space defined between the sealing member 220 and the home bar frame 64 and thus easily decreases to the saturation temperature, is supplied with a larger quantity of heat, and the first gasket section 271, 272 and 273, which is positioned far from the space defined between the sealing member 220 and the home bar frame 64, is supplied a smaller quantity of heat.

Accordingly, the embodiment uses a plurality of heaters generating different quantities of heat per unit time so as to supply a larger quantity of heat to a gasket section that easily decreases in temperature and to supply a smaller quantity of heat to a gasket section that does not easily decreases in temperature. As a result, energy is conserved, and formation of dew at the gasket 270 is quickly prevented.

The first heater 211 and the second heater 212 may create heat in various ways. For example, the first heater 211 and the second heater 212 may be embodied as an electric heater that is activated by electric energy. The first heater 211 and the second heater 212 embodied by the electric heater provides an advantage of facilitating temperature control.

The first heater 211 and the second heater 212 may be configured to have different quantities of heat per unit time.

In an example, the first heater 211 and the second heater 212 may have different electric powers (W). Specifically, electric power of the second heater 212 may be higher than that of first heater 211.

In another example, the first heater 211 and the second heater 212 may have different resistances. Specifically, the second heater 212 may have a higher resistance than that of the first heater 211.

In a further example, although the first heater 211 and the second heater 212 have the same resistance, there may be difference between rates of an ON time with respect to a unit time of the first heater 211 and the second heater 212. Specifically, the second heater 212 may have a higher rate of ON time per unit time than that of the first heater 211.

FIG. 11 is a rear view showing another example of the heat source according to the present invention.

Referring to FIG. 11, the heat source 210 may further include a third heater 213 positioned between the locking unit and a peripheral edge of the home bar door 200.

Specifically, the third heater 213 may be positioned closer to the peripheral edge of the home bar door 200 than the locking unit. Consequently, formation of dew at the locking unit may be prevented.

By way of example, the third heater 213 may be connected to the second heater 212, and the third heater 213 and the second heater 212 may be embodied as heaters having the same quantity of heat per unit time.

FIG. 12 is a control block diagram of the refrigerator according to the second embodiment of the present invention.

Referring to FIGS. 11 and 12, the refrigerator according to the present invention may further include a first moisture sensor 310, a second moisture sensor 320, and a control unit 400.

The first moisture sensor 310 and the second moisture sensor 320 detect moisture generated from the first peripheral section S211, S212 and S213 and the second peripheral section S214, respectively, and output signals to the control unit 400 based on the detection of moisture.

As shown in FIG. 11, the first moisture sensor 310 is positioned at the first peripheral sections S211, S212 and S213 of the rear surface of the home bar door 200.

The first moisture sensor 310 is connected to the control unit 400 for controlling operation of the first heater 211. When moisture is not detected by the first moisture sensor 310, the control unit 400 applies power to the first heater 211 so as to cause the first heater 211 to generate heat.

When moisture is not detected by the first moisture sensor 310 after operation of the first heater 211, the control unit 400 interrupts application of power to the first heater 211 to cause the first heater 211 to be inactive. In other words, the first heater 211 is selectively activated or deactivated depending on a measured value of the first moisture sensor 310.

As shown in FIG. 11, the second moisture sensor 320 is positioned at the second peripheral section S214 of the rear surface of the home bar door 200. Specifically, the second moisture sensor 320 is positioned close to the locking unit and outside the closed loop defined by the gasket 270.

The second moisture sensor 320 is connected to the control unit 400 for controlling operation of the second heater 212. When moisture is detected by the second moisture sensor 320, the control unit 400 applies power to the second heater 212 to cause the second heater 212 to generate heat.

When moisture is not detected by the second moisture sensor 320 after operation of the second heater 212, the control unit 400 interrupts application of the power to the second heater 212 to cause the second heater 212 to be inactive. In other words, the second heater 212 is selectively activated or deactivated depending on a measured value of the second moisture sensor 320.

For example, the first moisture sensor 310 and the second moisture sensor 320 may be embodied by one of a humidity sensor, an electrode sensor and a capacitive sensor.

Accordingly, since the first heater 211 and the second heater 212 are separately operated depending on measured values of the first moisture sensor 310 and the second moisture sensor 320, respectively, power consumption may be reduced.

As is apparent from the above description, the refrigerator according to the present invention has one or more of the following effects.

In one embodiment, since the gasket is outwardly spaced apart from a space between the sealing member and the storage compartment frame as much as possible, a temperature of the gasket is not lowered below the saturation temperature, thus preventing formation of dew at the gasket.

In one embodiment, since the gasket is outwardly spaced from a space defined between the sealing member and the storage frame as much as possible, a temperature of the gasket does not decrease below the saturation temperature, thus preventing formation of dew at the gasket.

In one embodiment, since a plurality of heaters generating different quantities of heat per unit time are used so as to supply a larger quantity of heat to a region which easily decreases in temperature and to supply a smaller quantity of heat to a region which does not easily decrease in temperature, energy is conserved and formation of dew at a gasket is rapidly prevented.

In one embodiment, since the locking unit for a door is disposed outside the closed loop defined by the gasket, formation of dew at the locking unit is prevented.

It will be appreciated by those skilled in the art to which the present invention pertains that the effects that can be achieved through the present invention are not limited to what has been particularly described hereinabove and other advantages of the present invention will be more clearly understood from the accompanying claims.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a main body including a storage compartment defined therein;

a cooling device for cooling the storage compartment;

a door for opening and closing the storage compartment;

a gasket disposed between the door and the main body to seal the storage compartment; and a heat source disposed around the door, wherein the heat source includes a plurality of heaters generating different quantities of heat, and wherein a periphery of the door comprises a plurality of regions, and the plurality of heaters are provided at the plurality of regions, respectively.

2. The refrigerator according to claim 1, wherein the plurality of heaters of the heat source comprises:

a first heater disposed at a first region, among the plurality of regions, at the periphery of the door; and a second heater disposed at a second region, among the plurality of regions, at the periphery of the door, wherein the first heater is positioned closer to a peripheral edge of the door than the second heater, and is configured to generate a quantity of heat per unit time smaller than that of the first heater.

3. The refrigerator according to claim 2, wherein the gasket is disposed at a position corresponding to the heat source.

4. The refrigerator according to claim 3, wherein the door includes a locking unit for coupling the door to the main body, wherein the locking unit is disposed between the second heater and the peripheral edge of the door.

5. The refrigerator according to claim 4, wherein the gasket defines a closed loop, and the locking unit is disposed outside the closed loop defined by the gasket.

6. The refrigerator according to claim 3, wherein the heat source is embedded in one of the door or the main body.

7. The refrigerator according to claim 6, further comprising: a sealing member protruding from a rear surface of the door to seal the storage compartment.

8. The refrigerator according to claim 7, wherein the gasket is disposed to surround the sealing member in a state of being spaced apart from the sealing member.

9. The refrigerator according to claim 7, wherein the heat source is disposed to surround the sealing member in a state of being outwardly spaced apart from the sealing member, wherein a spacing distance between the first heater and a peripheral edge of the sealing member is greater than that between the second heater and the peripheral edge of the sealing member.

10. The refrigerator according to claim 2, wherein the first and second heaters are electric heaters.

11. A refrigerator comprising:

a main body including a storage compartment defined therein;

a cooling device for cooling the storage compartment;

a door for opening and closing the storage compartment;

a home bar frame including a recess formed in the door;

a home bar door swingably hinged to the home bar frame to open and close the recess;

a gasket disposed between the home bar door and the home bar frame to seal the recess; and a heat source disposed around the home bar door, wherein the heat source includes a plurality of heaters generating different quantities of heat, and wherein a periphery of home bar door comprises a plurality of regions, and the plurality of heaters are provided at the plurality of regions, respectively.

12. The refrigerator according to claim 11, wherein the plurality of heaters of the heat source comprises:

a first heater disposed at a first peripheral region, among the plurality of regions, at the periphery of the home bar door; and a second heater disposed at a second peripheral region, among the plurality of regions, at the periphery of the home bar door, wherein the first heater is positioned closer to a peripheral edge of the home bar door than the second heater, and is configured to generate a quantity of heat per unit time smaller than that of the first heater.

13. The refrigerator according to claim 12, wherein the gasket is disposed at a position corresponding to the heat source.

14. The refrigerator according to claim 13, wherein the home bar door includes a locking unit for coupling the home bar door to the door, wherein the locking unit is disposed between the second heater and the peripheral edge of the home bar door.

15. The refrigerator according to claim 14, wherein the gasket defines a closed loop, and the locking unit is disposed outside the closed loop defined by the gasket.

16. The refrigerator according to claim 15, further comprising: a sealing member protruding from a rear surface of the home bar door to seal the recess.

17. The refrigerator according to claim 16, wherein the gasket is disposed to surround the sealing member.

18. The refrigerator according to claim 16, wherein the heat source is disposed to surround the sealing member in a state of being outwardly spaced apart from the sealing member, wherein a spacing distance between the first heater and a peripheral edge of the sealing member is greater than that between the second heater and the peripheral edge of the sealing member.

19. The refrigerator according to claim 12, wherein the heat source is embedded in one of the door or the main body.

20. The refrigerator according to claim 12, further comprising:

a first moisture sensor disposed at the first peripheral region to measure moisture; and a second moisture sensor disposed at the second peripheral region to measure moisture, wherein the first heater is configured to be selectively turned on or off depending on a measured value of the first moisture sensor, and the second heater is configured to be selectively turned on or off depending on a measured value of the second moisture sensor.

* * * * *